US005230181A

United States Patent [19]

Geoffrey et al.

[11] Patent Number: 5,230,181

[45] Date of Patent: Jul. 27, 1993

[54] ADJUSTABLE THRESHOLD ASSEMBLY WITH WATER-IMPERVIOUS SEAL

[75] Inventors: David C. Geoffrey, Richmond; Harold R. McGough, Sr., Williamsburg, both of Ind.

[73] Assignee: Imperial Products, Inc., Richmond, Ind.

[21] Appl. No.: 993,840

[22] Filed: Dec. 21, 1992

[51] Int. Cl.[5] ..... E06B 1/70

[52] U.S. Cl. ..... 49/469; 49/475.1

[58] Field of Search ..... 49/467, 468, 469, 475, 49/489, 304; 296/159, 209, 146 R, 152, 146 F; 277/227, 212 F

[56] References Cited

U.S. PATENT DOCUMENTS

| | | | |
|---|---|---|---|
| 2,718,677 | 9/1955 | Cornell | 49/489 X |
| 2,969,252 | 1/1961 | Gruver | 49/489 X |
| 2,976,584 | 3/1961 | Ghormley | 49/469 X |
| 3,276,167 | 10/1966 | Bus et al. | 49/489 X |
| 3,448,543 | 6/1969 | Multer | 49/489 X |
| 3,967,412 | 7/1976 | Gouernale | 49/468 |
| 4,399,636 | 8/1983 | Blackwell | 49/469 |
| 4,447,987 | 5/1984 | Lesosky | 49/469 X |
| 5,001,865 | 3/1991 | Procton | 49/469 |
| 5,010,690 | 4/1991 | Geoffrey | 49/468 |

FOREIGN PATENT DOCUMENTS 8100371 2/1981 PCT Int'l Appl. ..... 277/212 FB

*Primary Examiner*—Peter M. Cuomo
*Assistant Examiner*—Jerry Redman
*Attorney, Agent, or Firm*—Jacox & Meckstroth

[57] ABSTRACT

An extruded aluminum elongated sill member is supported by a wood base member and includes a sloping top wall integrally connected to a lower base wall positioned within a recess in the wood base member. A longitudinally extending wood trim member is attached to the wood base member and cooperates with the lower base wall to define a longitudinally extending cavity which receives a vertically adjustable rail member. The sill and rail members define corresponding longitudinally extending adjacent slots, and a longitudinally extending sealing member of extruded plastics material includes opposite semi-rigid edge portions with flexible fins which are pressed into the slots. The edge portions are integrally connected by a flexible U-shaped intermediate portion which is confined between the sill and rail members and forms a rolling diaphragm for vertically adjusting the rail member while maintaining a positive water-impervious seal therebetween. A rib on the sealing member deflects water and foreign particles from the U-shaped portion.

19 Claims, 1 Drawing Sheet

ADJUSTABLE THRESHOLD ASSEMBLY WITH WATER-IMPERVIOUS SEAL

BACKGROUND OF THE INVENTION

This invention relates to an adjustable threshold assembly of the general type disclosed in U.S. Pat. No. 5,010,690 which issued to the assignee of the present invention. In this assembly, a sliding water seal is provided between the outer exposed portion of the sill member and the vertically adjustable rail member which receives a flexible sweep seal mounted on the bottom edge portion of a swinging door. The above patent discloses the use of an extruded semi-rigid sealing element having a series of vertically spaced flexible fins for slidably engaging the opposing vertical surface of the adjustable rail member. Other forms of extruded sealing members which are mounted on the sill members and slidably engage adjustable rail members, are disclosed in U.S. Pat. Nos. 3,967,412 and 5,001,865.

It has been found highly desirable to provide a threshold assembly with an adjustable rail member for obtaining an effective seal between the threshold assembly and the bottom edge portion of a swinging door it its closed position. However, a sliding water seal between the adjustable rail member and the sill member always provides the possibility of a leak path developing between the sealing member and the rail member, for example, by a small stick or pebble which is deposited on the sealing member by the shoe of a person crossing the threshold. If water leaks past the sliding sealing member, it is possible for the water to penetrate and damage the underlying wood base of the threshold assembly or the wood floor which supports the threshold assembly.

SUMMARY OF THE INVENTION

The present invention is directed to an improved adjustable threshold assembly which incorporates a positive water-impervious seal or sealing member between the sill member and the adjustable rail member, regardless of the adjusted vertical position of the rail member. As a result, water is prevented from seeping between the sill and rail members at any position of the rail member.

In accordance with one embodiment of the invention, the sill member is extruded of aluminum and has a vertical slot adjacent the rail member which is formed with an adjacent horizontal slot. A sealing member of extruded plastics material includes semi-rigid leg portions which have flexible fins and project into the slots along the full length of the sill and rail members. The sealing member also includes a flexible intermediate portion which is folded to form a U-shaped portion between the sill and rail members. The U-shaped portion forms a rolling diaphragm during vertical adjustment of the rail member. The sill leg portion of the extruded sealing member also includes a deflector rib which projects across the top of the U-shaped portion to deflect water and foreign particles from the rolling diaphragm portion.

Other features and advantages of the invention will be apparent from the following description, the accompanying drawing and the appended claims.

DESCRIPTION OF THE PREFERRED EMBODIMENTS

Figure 1:
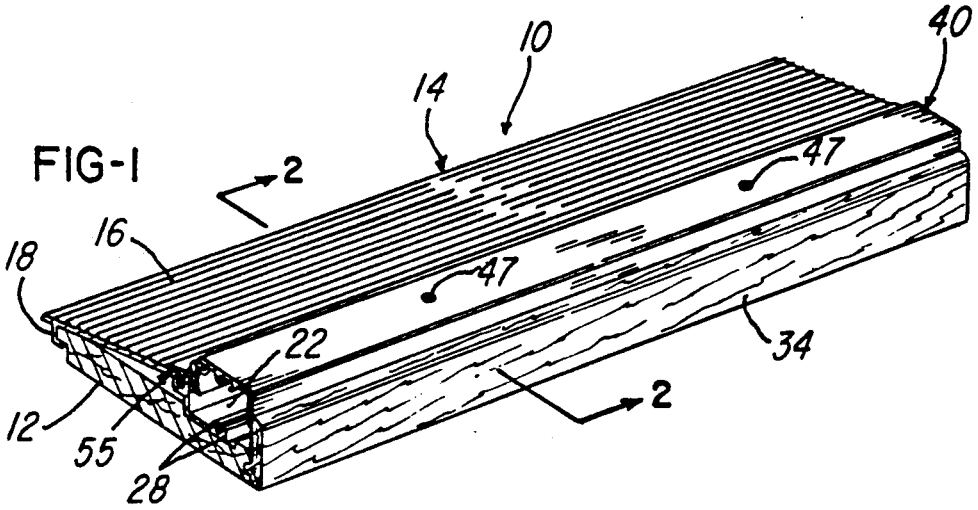
FIG. 1 is a perspective view of an adjustable threshold assembly constructed in accordance with the invention.

FIG. 1 illustrates a threshold assembly 10 which is adapted to be mounted on sub-flooring below a swinging or sliding door and includes an elongated base member 12 which is preferably formed of wood such as spruce. The base member 12 is covered by an elongated sill member 14 which is preferably extruded of aluminum and includes a sloping top wall 16 and an outer wall 18 which hooks onto the base member 12. The sill member 14 also includes a downwardly projecting L-shaped portion 22 which connects with the top wall 16 by a U-shaped portion 23 defining a longitudinally extending slot 26 with inwardly projecting fine serration.

The L-shaped portion 22 of the sill member 14 has a pair of upwardly projecting and longitudinally extending ribs 28 in which are formed longitudinally spaced threaded holes 29. The holes 29 align with corresponding holes 31 within the wood base member 12. A longitudinally extending wood trim member 34 is secured by fastener and adhesive to the base member 12 and cooperates with the L-shaped portion 22 of the sill member 14 to define a longitudinally extending cavity 35.

An elongated rail member 40 is also extruded of aluminum material and has an inverted channel-like configuration. The rail member 40 has a longitudinally extending dove-tailed slot 42 in which is inserted the flat socket head portions of a series of longitudinally spaced threaded fasteners 44. The fasteners 44 are threaded into the corresponding holes 29, and a series of small holes 47 are drilled or formed within the top surface of the rail member 40 in alignment with the holes and screws 44. The rail member 40 is adjusted vertically by inserting a Phillips head tool through the holes 47 into the recessed type screws 44 so that rotation of the screws 44 adjust the rail member 40 in a vertical direction. The drilled holes 31 within the wood base member 12 provide a snug fit with the screws 44. The rail member 40 also includes a U-shaped corner portion 52 which defines a longitudinally extending horizontal slot 53 with inwardly projecting fine serrations.

Figure 3:
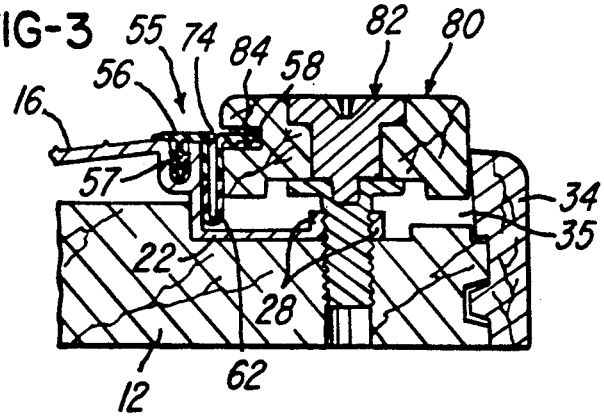
FIG. 3 is a fragmentary section similar to FIG. 2 and showing another embodiment of the invention.
Figure 4:
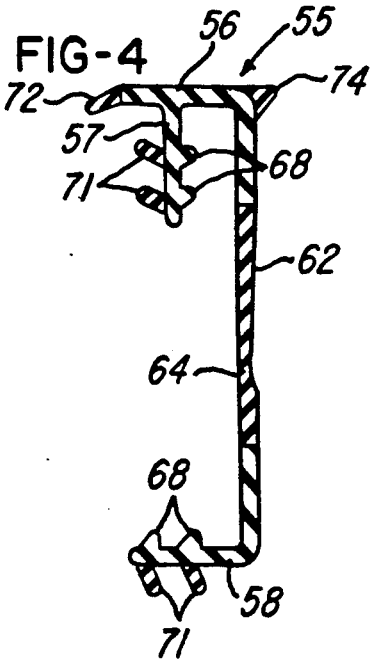
FIG. 4 is an enlarged cross-section of the extruded sealing member shown in FIGS. 2 and 3.

The sill member 14 and rail member 40 are interconnected along the full length of the members by a continuous sealing member 55 which is extruded of a thermoplastic material of duel or different durometers. The sealing member 55 includes a semi-rigid first leg portion 56 (FIG. 4) having a rib 57 and an opposite semi-rigid second leg portion 58. The leg portions 56 and 58 are integrally connected by a flexible intermediate portion 62 which has a lower durometer and is substantially more flexible than the leg portions 56 and 58. The intermediate portion 62 tapers in cross-sectional configuration to define a more flexible thinner portion 64 where the intermediate portion initially bends when folded into a U-shaped portion as shown in FIGS. 2 and 3.

The leg portions 56 and 58 are each extruded with longitudinally extending parallel ribs 68 of the more rigid and higher durometer material. The lower durometer and more flexible material forms the intermediate portion 62 and also forms a pair of flexible fins 71 on each leg portion, an outwardly projecting lip portion 72 and a flexible deflector rib 74 on the corner of the first leg portion 56.

Figure 2:
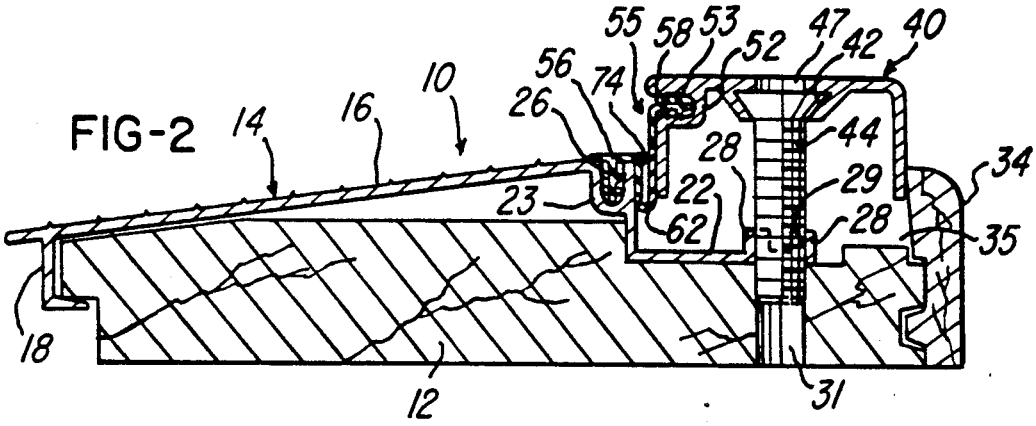
FIG. 2 is a section of the assembly as taken generally on line 2—2 of FIG. 1 and showing one embodiment of the invention.

As shown in FIG. 2, the sealing member 55 is folded so that the intermediate portion 62 becomes U-shaped and forms a rolling diaphragm within a narrow gap or space defined between the sill member 14 and rail member 40. The rib 57 of the first leg portion 56 is pressed downwardly into the slot 26 within the sill member 14 and is retained by the fins 68 and 71 with the leg portion 56 positively covering and sealing the slot 26. The fins 68 and 71 on the first leg portion 56 engage the fine serration within the slot 26 and positively connect the leg portion 56 to the sill member 14 as shown in FIG. 2. The second leg portion 58 is pressed into the slot 53 so that when the ribs or fins 68 and 71 engage the fine serration within the slot 53, the second leg portion 58 is positively connected to the rail member 40.

As apparent from FIG. 2, when the rail member 40 is adjusted vertically for properly engaging the resilient or flexible seal on the bottom of the swinging door, the intermediate portion 62 of the sealing member 55 rolls up and down like a rolling diaphragm, and the deflector rib 74 slidably contacts the intermediate portion 62 for deflecting any water or dirt or other foreign particles from entering the U-shaped intermediate portion 62.

Referring to FIG. 3, in some installations of an adjustable threshold assembly, it is desirable to use a wood rail member 80 in place of the extruded aluminum rail member 40 in order to provide the appearance of wood. The rail member 80 is adjusted vertically by rotating a series of longitudinally spaced captive screw assemblies 82 which are constructed and assembled in the same manner as the screw assemblies 72 disclosed in above-mentioned U.S. Pat. No. 5,010,690, the disclosure of which is hereby incorporated by reference.

The adjustable rail member 80 is formed with a longitudinally extending horizontal slot 84 which receives the second leg portion 58 of the sealing member 55 in the same manner as the slot 53 receives the leg portion 58 as described above in connection with FIG. 2. The rail member 80 is shown in its lowermost position in FIG. 3, and the rail member 40 is shown in its uppermost position in FIG. 2 to illustrate the two limit positions of the sealing member 55 and the rolling diaphragm action of the folded or U-shaped intermediate portion 62 of the sealing member.

Preferably, a flexible silicone sealant is inserted into opposite end portions of the U-shaped intermediate portion 62 of the sealing member 55. Thus in the event any water seeped past the deflector rib 74 and into the narrow channel defined by the U-shaped intermediate portion 62, the water is trapped within the channel and does not seep outwardly from the ends of the channel into the wood base member 12. It is also desirable to form a water-tight seal between the opposite end surfaces of the sill and rail members and the adjacent or abutting surfaces of the vertical jamb members (not shown) of the door frame. Such a seal may be formed by a silicone sealant or thin resilient closed cell foam pads.

From the drawing and the above description, it is apparent that an adjustable threshold assembly constructed in accordance with the present invention, provides desirable features and advantages. For example, the sealing member 55 forms a positive and water-impervious seal between the sill member 14 and rail member 40 or 80 along the entire length of the threshold assembly while still permitting vertical adjustment of the rail member after installation of the threshold assembly. Furthermore, the rolling diaphragm intermediate portion 62 of the sealing member 55 does not rely upon a sliding seal with the adjustable rail member and thereby eliminates the possibility of a leak path developing after the threshold assembly is used and exposed to the weather for a period of years.

While the forms of threshold assembly herein described constitutes preferred embodiments of the invention, it is to be understood that the invention is not limited to these precise forms of threshold assembly, and that changes may be made therein without departing from the scope and spirit of the invention as defined in the appended claims.

The invention having thus been described, the following is claimed:

1. A threshold assembly adapted to be installed below a bottom surface of a movable door, comprising an elongated sill member including a sloping top surface and connected to means defining a longitudinally extending and upwardly facing cavity, an elongated rail member disposed within said cavity, means for adjusting said rail member vertically within said cavity, means defining a longitudinally extending first slot within said sill member, means defining a longitudinally extending second slot within said rail member, an elongated sealing member including spaced longitudinally extending first and second portions integrally connected by a flexible intermediate portion, said first portion projecting into said first slot within said sill member, said second portion projecting into said second slot within said rail member, means for positively securing each of said portions within the corresponding said slot, and said flexible intermediate portion of said sealing member providing for vertically adjusting said rail member while maintaining a continuous longitudinally extending water and air-impervious seal between said sill and rail members.

2. The threshold assembly as defined in claim 1 wherein said flexible intermediate portion forms a generally U-shaped section confined within a narrow gap defined between said sill and rail members.

3. A threshold assembly as defined in claim 1 wherein said first portion includes a deflector rib for slidably engaging said second portion of said sealing member.

4. A threshold assembly as defined in claim 1 wherein said securing means for each of said first and second portions comprise a plurality of longitudinally extending flexible fins projecting outwardly within the corresponding slots to engage the corresponding sill and rail members.

5. A threshold assembly as defined in claim 1 wherein said first slot within said sill member is generally vertical, and said first portion covers said slot and includes a longitudinally extending rib projecting downwardly into said first slot.

6. A threshold assembly as defined in claim 1 wherein said second slot within said rail member is generally horizontal, and said second portion includes a longitudinally extending rib projecting horizontally into said second slot.

7. A threshold assembly as defined in claim 1 wherein said intermediate portion includes a flexible thinner wall section to facilitate folding said wall section.

8. A threshold assembly as defined in claim 1 wherein said sealing member comprises a single extrusion of integrally connected semi-rigid and flexible materials having different durometers.

9. A threshold assembly as defined in claim 1 wherein said rail member comprises a section of extruded aluminum, and said rail member has an outer portion defining a generally horizontal said second slot for receiving said second portion of said sealing member.

10. A threshold assembly as defined in claim 1 wherein said rail member comprises a wood rail member having an outer defining a generally horizontal said second slot for receiving said second portion of said sealing member.

11. A threshold assembly adapted to be installed below a bottom surface of a movable door, comprising an elongated sill member including a sloping top surface and connected to means defining a longitudinally extending and upwardly facing cavity, an elongated rail member disposed within said cavity, means for adjusting said rail member vertically within said cavity, an elongated sealing member including spaced longitudinally extending first and second edge portions integrally connected by a flexible intermediate portion, means for positively connecting said first edge portion to said sill member, means for positively connecting said second edge portion to said rail member, and said flexible intermediate portion of said sealing member forms a generally U-shaped section between said sill and rail members and provides for vertically adjusting said rail member while maintaining a continuous longitudinally extending water and air-impervious seal between said sill and rail members.

12. A threshold assembly as defined in claim 11 wherein said first edge portion includes a deflector rib for slidably engaging said second edge portion of said sealing member.

13. A threshold assembly as defined in claim 11 wherein said sill member and rail member have corresponding longitudinally extending slots, and said connecting means for said first and second edge portions comprise longitudinally extending semi-rigid ribs projecting into said slots and having means engaging the corresponding said sill and rail members.

14. A threshold assembly as defined in claim 13 wherein said slot within said sill member is generally vertical, and said first edge portion covers said slot and includes a longitudinally extending rib projecting downwardly into said slot within said sill member.

15. A threshold assembly as defined in claim 13 wherein said slot within said rail member is generally horizontal, and said second edge portion includes a longitudinally extending rib projecting generally horizontally into said slot within said rail member.

16. A threshold assembly as defined in claim 11 wherein said sealing member comprises a single extrusion of integrally connected semi-rigid and flexible materials having different durometers.

17. A threshold assembly as defined in claim 11 wherein said rail member comprises a section of extruded aluminum, and said rail member has an outer portion defining a generally horizontal slot for receiving said second edge portion of said sealing member.

18. A threshold assembly as defined in claim 11 wherein said rail member comprises a wood rail member having an outer surface defining a generally horizontal said slot for receiving said second edge portion of said sealing member.

19. A threshold assembly adapted to be installed below a bottom surface of a movable door, comprising an elongated sill member including a sloping top surface and connected to means defining a longitudinally extending and upwardly facing cavity, an elongated rail member disposed within said cavity, means for adjusting said rail member vertically within said cavity, means defining a longitudinally extending and generally vertical first slot within said sill member, means defining a longitudinally extending and generally horizontal second slot within said rail member, an elongated sealing member of extruded plastics material and including spaced longitudinally extending first and second semi-rigid leg portions integrally connected by a flexible intermediate portion, said first leg portion projecting into said first slot within said sill member, said second leg portion projecting into said second slot within said rail member, fin means for positively securing each of said leg portions within the corresponding said slot, and said flexible intermediate portion of said sealing member forming a generally U-shaped section confined within a narrow gap defined between said sill and rail members to provide for vertically adjusting said rail member while maintaining a continuous longitudinally extending water and air-impervious seal between said sill and rail members.

* * * * *